US006220913B1

(12) United States Patent
Makita et al.

(10) Patent No.: US 6,220,913 B1
(45) Date of Patent: Apr. 24, 2001

(54) MECHANISM AND METHOD FOR AUTOMATICALLY TRANSFERRING SUPPORT PILLARS

(75) Inventors: Yoshio Makita; Nobuhiko Takashima; Katsunosuke Ozawa; Tatsuo Yamaura; Satoshi Yoshikata; Masayuki Itakura, all of Mobara (JP)

(73) Assignee: Futaba Denshi Kogyo Kabushiki Kaisha, Mobara (JP)

( * ) Notice: Subject to any disclaimer, the term of this patent is extended or adjusted under 35 U.S.C. 154(b) by 0 days.

(21) Appl. No.: 09/247,084

(22) Filed: Feb. 9, 1999

(30) Foreign Application Priority Data

Feb. 27, 1998 (JP) ..... 10-047345

(51) Int. Cl.[7] ..... H01J 9/00
(52) U.S. Cl. ..... 445/24
(58) Field of Search ..... 445/24, 66; 29/743

(56) References Cited

U.S. PATENT DOCUMENTS 5,789,857 * 8/1998 Yamaura et al. ..... 313/495

* cited by examiner

*Primary Examiner*—Kenneth J. Ramsey
*Assistant Examiner*—Todd Redd Hopper
(74) *Attorney, Agent, or Firm*—Oblon, Spivak, McClelland, Maier & Neustadt, P.C.

(57) ABSTRACT

An automatic support pillar transfer mechanism is provided that enables an enlarged transfer range, reduced produce failure and mass-production. The touch sensors 17*a* to 7*c* are arranged on the moving section 12 to measure the plane orientation of the surface of the jig 7. The jig adjusting section 6 is driven based on the measurement results on the plane orientations of surfaces of the jig 7 to adjust the surface of the jig 7 in parallel. With plural support pillars 15 sucked and held at predetermined intervals by the jig 7 adjusted in parallel, the bonding agent coated substrate 14 attached on the moving section 12 is descended to coat the bonding agent 13 onto the one ends of the support pillars 15. The substrate 16 to which the support pillars 15 are transferred is attached to the moving section 12. Variations in plane orientation of surfaces of the substrate 16 are respectively measured by means of the touch sensors 5*a* to 5*c*. The jig adjusting section 6 is driven according to the variations in plane orientation of the surfaces of the substrate 16. With the surface of the jig 7 arranged in parallel to the surface of the substrate 16, the moving section 12 is descended to transfer the support pillars 15 onto the surface of the substrate 16.

4 Claims, 3 Drawing Sheets

52
51

52
51

15

53
55
15
54a
54
SUCTION
56
57
SUCTION APPARATUS 59
61
55
15
54a
58
54
53
SUCTION
56

60
61
55
15
54a
58
54
53
SUCTION
56

15
60

MECHANISM AND METHOD FOR AUTOMATICALLY TRANSFERRING SUPPORT PILLARS

BACKGROUND OF THE INVENTION

The present invention relates to an automatic support pillar transfer mechanism that arranges pressure-resistant support pillars within an envelope used for a display device which contains field emission cathodes acting as electron sources and to a support pillar transferring method.

In flat display devices such as field emission displays (FEDs) where field emission cathodes are used as electron sources, an envelope formed of thin glass plates is maintained in a high-evacuated state. In order to sufficiently withstand the external pressure, supports called as support pillars are needed between an anode substrate on which display sections are formed with fine pitches and a cathode substrate on which cathode electrodes are formed. In order to support the substrates without disturbing the display, glass fibers, for example, short fibers of an outer diameter of several tens $\mu$m are used as the support pillar.

Glass fibers with a smooth cut cross section and a uniform length must be used as support pillars to be erected within an envelope for the field emission display. A conventional process of fabricating support pillars satisfying the above-mentioned requirements will be explained below by referring to FIGS. 3(*a*) to 3(*g*).

Plural glass fibers 51 are arranged on the flat glass substrate 52. In concrete, a continuous glass fiber is cut into glass fiber pieces with a predetermined length. The plural cut glass fibers 51 are closely arranged in parallel on the glass substrate 52 (refer to FIG. 3(*a*)). In this case, the glass fibers 51 are damped with an organic solvent to prevent static electricity.

A bonding agent is applied on the glass fibers 51. Thus, the glass fibers 51 are temporarily fixed on the glass substrate 52. With the bonding agent solidified on the glass fibers 51, the glass fibers 51 are cut at constant intervals using, for example, a cutter with a diamond blade (FIG. 3(*b*)). Thereafter, the bonding agent coated on the glass fibers 51 is dissolved to remove the cut glass fibers 51 from the glass substrate 52. Thus, a plurality of support pillars 15 of a predetermined length are fabricated (FIG. 3(*c*)).

The support pillars 15 thus fabricated are arranged using the special jig 53 shown in FIG. 3(*d*). The jig 53 consists of a positioning plate 54, a cushioning material 55, a porous material 56 and a suction apparatus 57. The positioning plate 54 has through holes 54*a* corresponding to the arranging positions of the support pillars 15 to be inserted into the substrate. The cushioning material 55 is closely placed on the lower portion of the positioning plate 54 and is formed of a resilient Teflon sheet. The porous material 56 is closely placed on the lower surface of the cushioning material 55 and is formed of a metal such as a stainless steel plate with enormous porosities (e.g. of a diameter of 100 to 300 $\mu$m). The suction apparatus 57 sucks and holds the support pillars 15 inserted into the through holes 54*a* of the positioning plate 54 via both the cushioning material 55 and the porous material 56.

In order to arrange the support pillars within an envelope, one end surfaces of the support pillars 15 are sucked using the suction apparatus 57 to insert them into the through holes 54*a*. Thus, the one end surfaces of the support pillars 15 are closely held on the surface of the cushioning material 55 by suction while plural support pillars 15 are being inserted into the through holes 54*a* in an arranged state (FIG. 3(*d*)). Next, the bonding agent coated substrate 59, over which a bonding agent is coated, is forcibly placed on the one end surfaces of the support pillars 15 in parallel to the positioning plate 54, so that the bonding agent is coated on the one end surfaces of the support pillars 15 (FIG. 3(*e*)).

The anode substrate 60 used for constructing an envelope is placed under pressure and securely fixed on the ends of the support pillars 15 thus arranged on which the bonding agent 58 are coated (FIGS. 3(*f*) and (*g*)). Thereafter, the anode substrate 60, on which the support pillars 15 are securely fixed, is removed from the jig 53. Then a bonding agent is applied to the other end surfaces of the support pillars 15 and the outer fringe portion of the anode substrate 60. An envelope is formed by securely fixing the other end surfaces of the support pillars 15 to the anode substrate and by sealing the spaces between the outer fringe of the cathode substrate and the outer fringe of the anode substrate.

Since the support pillars 15 are evenly transferred onto the entire surface of the substrate forming an envelope for a field emission display (the anode substrate 60 in FIG. 3), it is needed to control the contact height (transfer height) between the ends of the support pillars and the substrate to a suitable value of ±10 $\mu$m.

Conventionally, as shown in FIG. 3, the support pillars 15 are transferred to the substrate while the condition where the substrate makes contact with the support pillar 15 at the nearest position from the side surface of the substrate is being observed under the microscope 61. At this time, the allowable range of heights of the support pillars 15 to be transferred depends on the cushioning material 55 inserted between the positioning plate 54 and the porous material 56. In concrete, a porous Teflon sheet of an average opening diameter of 3 $\mu$m is used to support the support pillars of a diameter of 50 $\mu$m. The resilient deformation range of 20 $\mu$m of the Teflon sheet provides a transfer allowable range.

However, the above-mentioned art has the following disadvantages.

Since the transfer height of the support pillar 15 is visually controlled under the microscope 61, it is difficult to realize an automatic support transfer operation. In some cases, some support pillars 15 may be transferred to the substrate so that a production failure may occur. It is difficult that the image recognition management using a CCD (Charge Coupled Device) or a computer, evolved from the above-mentioned method, provides a sufficient accuracy and leads to reduced production costs.

Moreover, plural jigs 53 are required for mass-production of display panels. However, because it is difficult to uniformly orient the respective upper surfaces of jigs 53, a variation of about 40 $\mu$m is assumed in consideration of the machining accuracy. The gradient of the plane orientation of the substrate is within a tolerance of about 20 $\mu$m. The transfer height is out of the allowable range by considering other mechanical accuracy so that a transfer failure may occur. Even when a single jig is used, the above-mentioned error factors limit the transfer range of the support pillar 15 to at most about 12 cm in diagonal line of a screen.

SUMMARY OF THE INVENTION

The present invention is made to solve the above-mentioned problems. The objective of the present invention is to provide an automatic support pillar transfer mechanism that realizes mass-production, enlarged transfer ranges and reduced product failure.

Another objective of the present invention is to provide an automatic support pillar transferring method that realizes mass-production, enlarged transfer ranges and reduced product failure.

The objective of the present invention is achieved by an automatic support pillar transfer mechanism comprising a jig for sucking and holding plural support pillars at predetermined intervals; measuring means for measuring a variation in plane orientation of a surface of the jig and a variation in plane orientation of a surface of a substrate onto which the support pillar is transferred; jig adjusting section for positioning and holding the jig and for adjusting the parallelism of the plane orientation of the jig surface based on measurement results from the measuring means; a moving section for vertically moving a substrate on which a bonding agent is applied or a substrate onto which the support pillars are transferred, wherein the substrate can be attached to or detached from the moving section; and control means for controlling movement of the moving means so as to apply the bonding agent on the support pillars or to transfer the support pillars on which the bonding agent is applied, to the substrate, based on the measurement results from the measuring means.

In the automatic support pillar transfer mechanism according to the present invention, the measuring means comprises jig surface detecting means arranged at least three points on the surface of said moving section and not positioned along the same straight line, for detecting the presence or absence of contact to a surface of said jig, any one of the at least three points being set as a reference point, substrate detecting means for arranged at at least three points on the surface facing a surface of the moving section and not positioned along the same straight line, for detecting the presence or absence of contact to a surface of the moving section, any one of the at least three points being set as a reference point, and length measuring means for measuring a movement amount from the reference point when the jig surface detecting means makes contact with a surface of the jig or when the substrate surface detecting means makes contact with a surface of the substrate; and wherein the control means controls the driving operation of the jig adjusting section based on a difference between a measurement value from the measuring means when the jig surface detecting means acting as a reference point makes contact with a surface of the jig and a measurement value from the measuring means when the remaining jig surface detecting means makes contact with a surface of the jig, and then adjusts the surface of the jig in parallel; and wherein the control means controls the driving operation of the jig adjusting section based on a difference between a measurement value from the measuring means when the substrate surface detecting means acting as a reference point makes contact with a surface of the substrate and a measurement value from the measuring means when the remaining substrate surface detecting means makes contact with a surface of the substrate, and then adjusts the surface of the jig to be in parallel to the surface of the substrate.

In the automatic support pillar transfer mechanism according to the present invention, the jig comprises a positioning plate having through holes through which the support pillars are inserted, the through holes being formed at predetermined intervals; a cushioning material formed of a fine porous material having a predetermined resilience; a porous material closely arranged to the lower portion of the cushioning material, the porous material having plural porosities of a predetermined diameter; a suction apparatus for sucking the support pillars inserted into the through holes via the cushioning material and the porous material.

Furthermore, according to the present invention, a support pillar transferring method comprises the steps of measuring the plane orientation of a surface of a jig which sucks and holds plural support pillars at predetermined intervals; adjusting the surface of the jig in parallel according to measurement results on the plane orientation of the surface of said jig; holding the plural support pillars in the jig adjusted in parallel by suction so as to be arranged at predetermined intervals and thus coating a bonding agent on one ends of the plural support pillars; measuring a variation in plane orientation of a surface of the substrate to which plural support pillars are transferred; and arranging the surface of the jig to the surface of the substrate in parallel according to the measurement results on the variation in plane orientation of the surface of the substrate and then transferring the plural support pillars to the surface of the substrate.

BRIEF DESCRIPTION OF THE DRAWINGS

This and other objects, features and advantages of the present invention will become more apparent upon a reading of the following detailed description and drawings, in which:

FIG. 1(*b*) is a schematic view illustrating an automatic support pillar transfer mechanism according to an embodiment of the present invention;

DESCRIPTION OF THE EMBODIMENTS

Next, an embodiment of the present invention will be described below in detail with reference to the attached drawings.

Figure 1A:
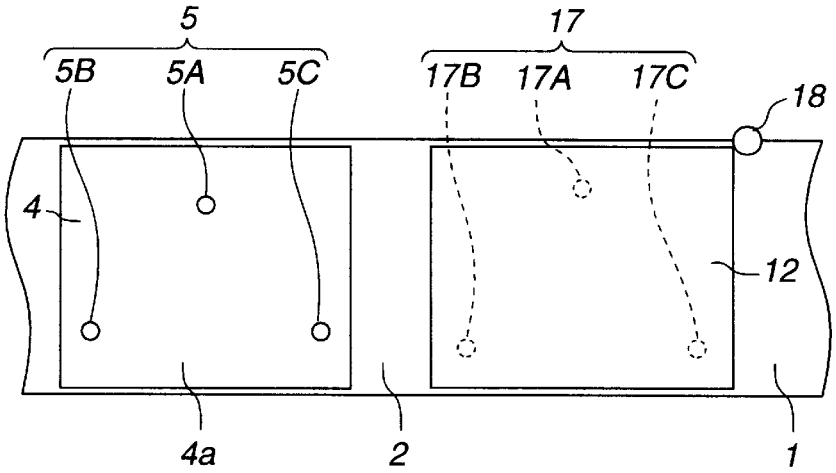
FIG. 1(*a*) is a plan view schematically and partially illustrating an automatic support pillar transfer mechanism according to an embodiment of the present invention.
Figure 1B:
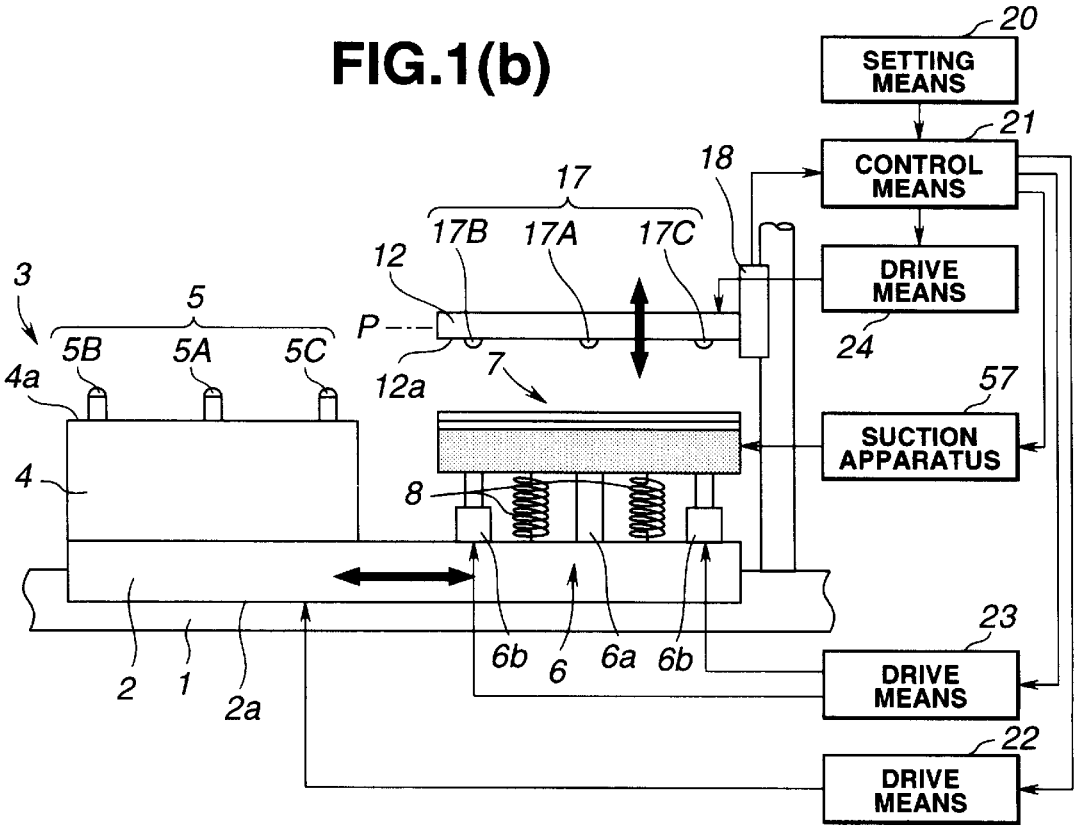
Figure 2A:
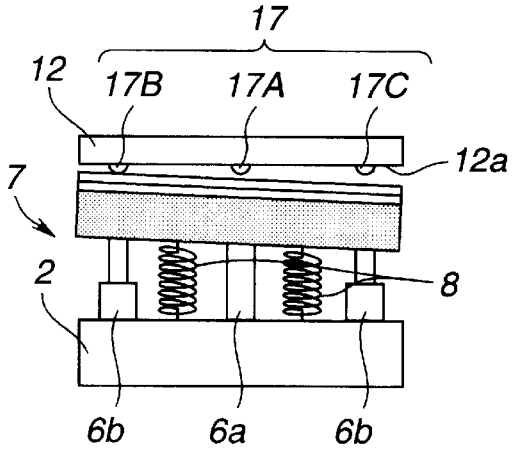
FIGS. 2(*a*) to 2(*f*) are cross sectional views each schematically illustrating an operation procedure of transferring support pillars using the automatic support pillar transfer mechanism.
Figure 2B:
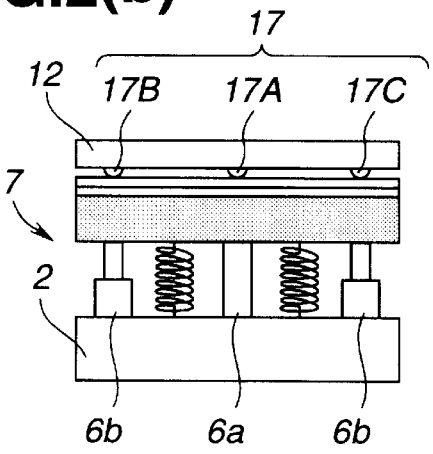
Figure 2C:
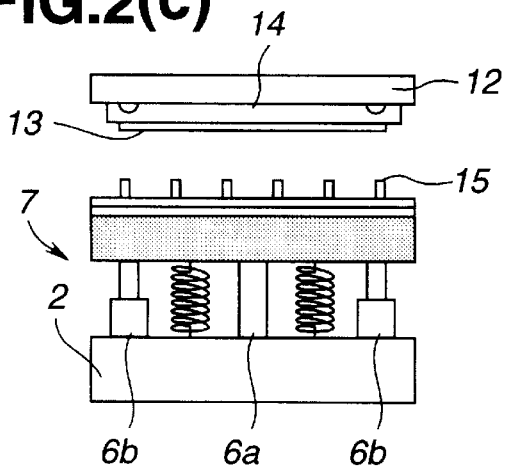
Figure 2D:
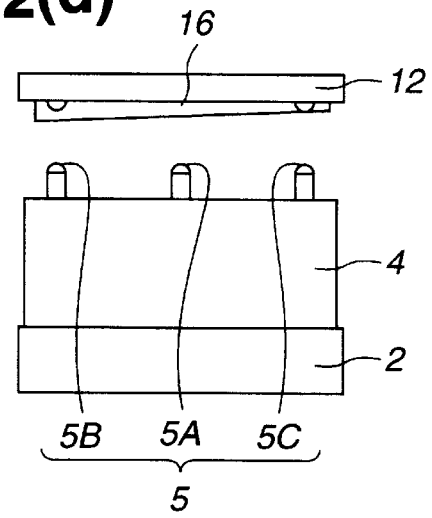
Figure 2E:
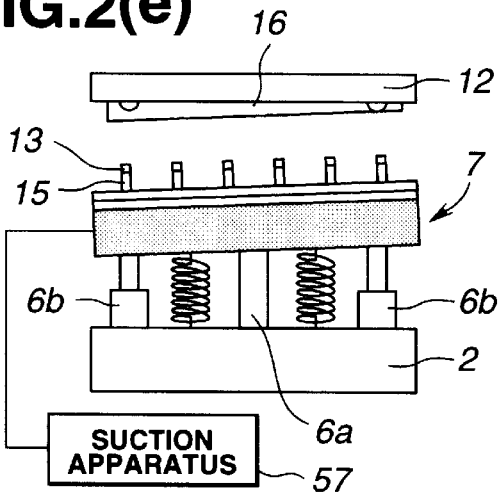
Figure 2F:
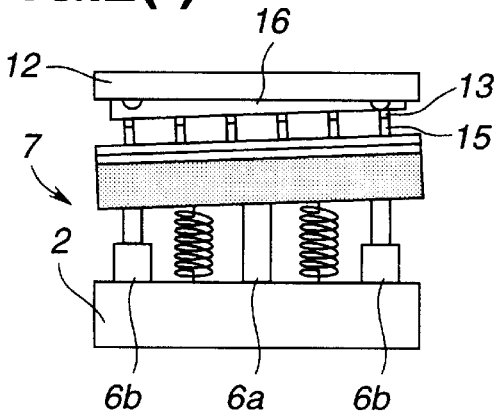

FIG. 1(*a*) is a plan view partially illustrating an automatic support pillar transfer mechanism according to an embodiment of the present invention. FIG. 1(*b*) is a side view illustrating an automatic support pillar transfer mechanism according to an embodiment of the present invention. FIGS. 2(*a*) to 2(*f*) are diagrams each illustrating a sequential operational procedure for transferring support pillars using an automatic support pillar transfer mechanism.

Referring to FIG. 1(*a*), in the automatic support pillar transferring mechanism according to the present invention, a movable table 2 with a smooth surface 2*a* is placed on the base 1. The movable table 2 can be moved in axial directions (or the arrow directions shown in FIG. 1(*b*)) by drive signals from the drive means 22 under control of the control means 21 (to be later described).

A substrate surface measuring section 3 that measures the surface parallelism of a substrate 16 onto which the support pillars 15 acting as work pieces are be transferred is transferred on the movable table 2. The substrate surface measuring section 3 consists of a rectangular block 4 securely fixed to the movable table 2 and having a smooth surface 4*a* and touch substrate surface detecting means 5 that detects the presence or absence of contact to the substrate 16.

As shown in FIG. 1(*a*), the substrate surface detecting means 5 consists of a substrate surface touch sensor 5A arranged at the upper center of the smooth surface 4*a* of the block 4 but not arranged along the same straight line, a substrate surface touch sensor 5B mounted on the left lower portion, and a substrate surface touch sensors 5C mounted on the right lower portion.

In this embodiment, the reference surface touch sensor 5A positioned at the center acts as a reference point. The reference surface touch sensors 5A to 5C output detection signals to the control means 21 (to be later described). The reference surface touch sensors are respectively arranged at least at three positions on the smooth surface 4a of the block 4.

The jig adjusting section 6 that adjusts the parallelism of the plane orientation of the surface of the jig 7 (to be later described) is placed on the movable table 2 along the moving direction of the movable table 2 and in parallel to the substrate surface measuring section 3. The jig adjusting section 6 includes a columnlike fixing section 6*a* facing the movable table 2 and securely fixed on the center upper portion of the movable table 2, a columnlike elevating section 6*b* mounted in ascendable and descenable states on the right portion of the movable table 2 positioned at an equal direction from the fixing section 6*a,* and a columnlike elevating section 6*b* mounted in ascendable and descenable states on the left portion of the movable table 2 positioned at an equal direction from the fixing section 6*a.*

The elevating section 6*b* is driven upward and downward at fine pitches by drive signals from the drive means 23 such as a piezoelectric element or step motor controlled by the control means 21 (to be later described) and according to the parallelism of the substrate.

Figures 3A, 3B, 3C, 3D, 3E, 3F, 3G:
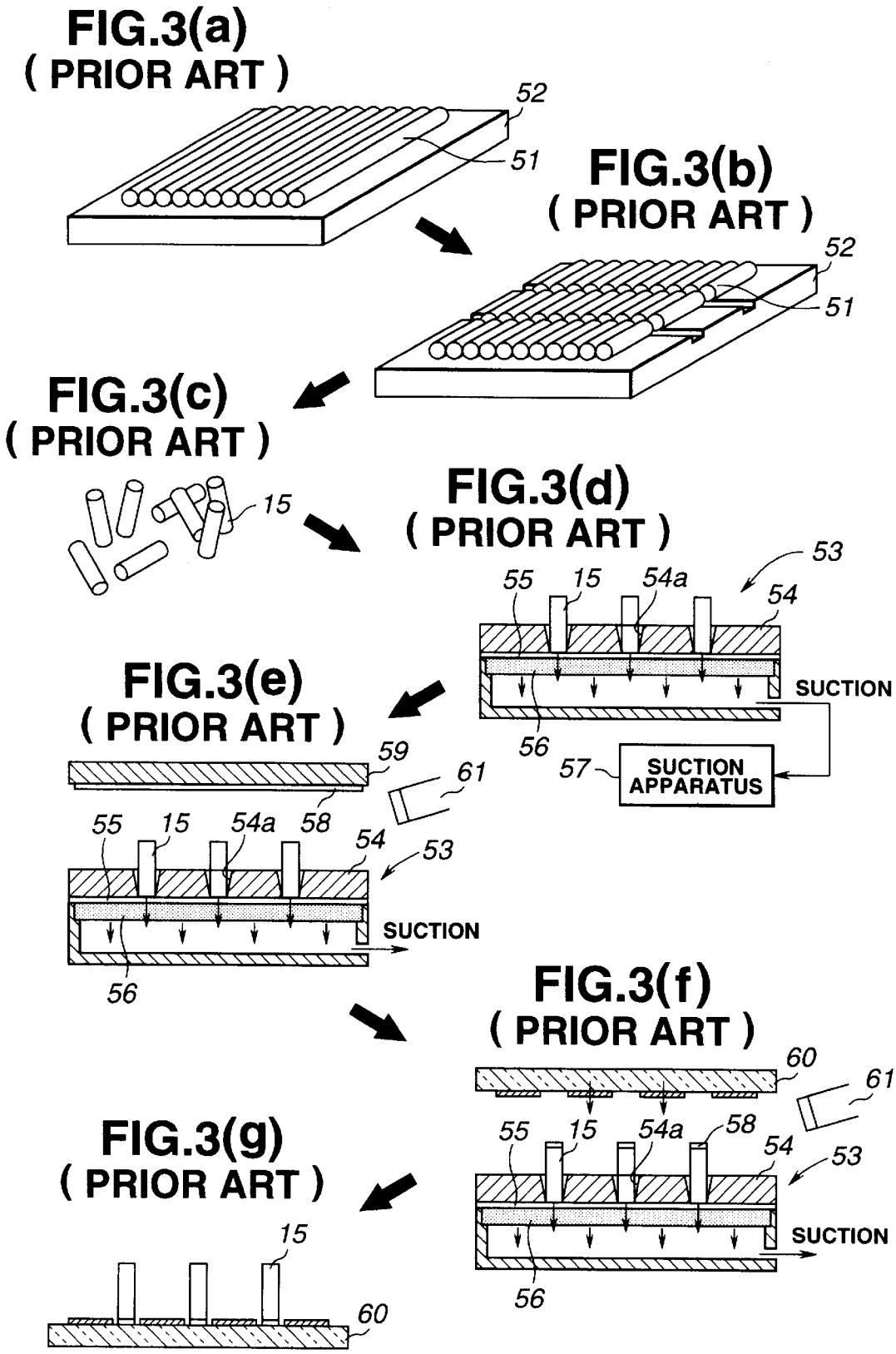
FIG.3(a) ( PRIOR ART )
FIG.3(b) ( PRIOR ART )
FIG.3(c) ( PRIOR ART )
FIG.3(d) ( PRIOR ART )
FIG.3(e) ( PRIOR ART )
FIG.3(f) ( PRIOR ART )
FIG.3(g) ( PRIOR ART )
FIGS. 3(*a*) to 3(*g*) are diagrams each illustrating a conventional support pillar transfer procedure.

As shown in FIG. 1(*b*), the jig 7, which sucks and holds support pillars to be arranged within an envelope for a field emission display, is supported on the jig adjusting section 6. The jig in this embodiment differs from the conventional jig shown in FIG. 3 in the quality of the cushioning material. That is, the jig 7, as shown in FIG. 3(*d*), is formed of a positioning plate 54, a cushioning material 10, a porous material 56, and a suction apparatus 57. The jig 7 is securely fixed to the movable table 2 so as not to shift its position with respect to the jig adjusting section 6. The coil spring holding means 8 biases the base surface of the jig 7 against the fixing section 6*a* and the upper surfaces of the elevating sections 6*b* and 6*b* at plural points of the upper surface of the fixing section 6.

The cushioning material 55 is formed of a material having a resilient deformation range to such an extent that a bonding paste does not adhere to the surface of the positioning plate 54 in the jig 7. In concrete, with the support pillar 15 acting as a work piece having a length of 200 $\mu$m, a resilient porous material such as an ethyl cellulose ester membrane filter having a resilient deformation range of about 40 $\mu$m is used.

As shown in FIG. 1(*b*), a main frame 11 is erected on the base 1 and nearly perpendicular to the movable table so as not to disturb the movement of the substrate surface measuring section 3 and the jig adjusting section 6. A rectangular moving section 12 is mounted to the main frame 11. The moving section 12 can vertically move (in the arrow directions shown in FIG. 1(*b*)) along the main frame 11 by drive signals from the drive means 24 under control of the control means 21 (to be later described). The three points of the reference surface touch sensor 5 on the reference surface measuring section 3 or the three points of the jig surface touch sensors 17 are calibrated with respect to the surface of the surface measuring section 3 and the surface of the jig adjusting section 6 facing the moving section 12.

As shown in FIG. 2, a bonding agent coated substrate 14 which has the surface facing the jig 7 on which a bonding paste 13 is coated and a substrate 16 (a substrate forming an envelope for a field emission display, for example, an anode substrate) which transfers support pillars 15 sucked and held by the jig 7 is removably attached on the smooth surface 12*a* of the moving section 12. The touch-type jig detecting means 17 that detects the presence or absence of contact to the jig 7 is mounted on the smooth surface 12*a* of the moving section 12 at the position where the substrate 16 can be arbitrarily mounted.

As shown with the broken line in FIG. 1(*a*), the jig surface detecting means 17 consists of a jig surface touch sensor 17A attached on the upper center of the smooth surface 12*a* of the moving section 12, a left jig surface touch sensor 17B attached on the left lower portion thereof and a right jig surface touch sensor 17C attached on the left lower portion thereof, so as not to be arranged along the same straight line on the smooth surface 12*a* of the moving section 12.

In the embodiment, the jig surface touch sensor 17A positioned on the center of the smooth surface 12*a* acts as a reference point. The detection signals from the jig surface touch sensors 17A to 17C are input to the control means 21 (to be later described). The jig surface touch sensors may be separately mounted at least at three positions on the smooth surface 12*a*.

As shown in FIG. 1(*b*), a length measuring device 18 that measures the movement of the moving section 12 from a predetermined reference position P (or from the upper dead point being the home position of the moving section 12) is mounted on the main frame. The length measuring device 18 can be used that includes the main frame 11 and the moving section 12 each having a scale with an optical grid, electro-optically reads Moiré fringes produced through a relative movement of the scales, and measures the relative movement amount between the two scales. The length measuring means is configured of the measuring device 18, the substrate surface detecting means 5, and the jig surface detecting means 17. The light measuring device 18 outputs measurement signals to the control means 21 (to be later described).

The setting means 20, shown in FIG. 1(*b*), sets a movement amount of the moving section 12 (or the bonding agent coated substrate 14) from a reference position P needed to transfer the bonding agent onto the support pillars 15, as a standard value Hp of a bonding agent transfer height. The setting means 20 also sets a movement amount of the moving section 12 (substrate 16) from a reference position P needed to transfer the support pillars 15 onto the substrate 16, as a standard value Hs of a support pillar transfer height. The setting means 20 inputs to the control means 21 an operation starting instruction for transferring the bonding agent 13 onto the support pillars 15 and then transferring the support pillars 15 with the transferred bonding agent 13 onto the substrate 16.

In order to execute the operational sequence shown in FIG. 2, when receiving an operation starting instruction from the setting means 20, the control means 21 respectively controls the drive means 22 for driving the movable table 2 based on detection signals from the touch sensors 5A to 5C and 17A to 17C and measurement signals from the length measuring device 18, the drive means 23 for driving the elevating sections 6*b* of the jig adjusting section 6, and the drive means 24 for driving the moving section 12.

Next, an operational sequence of transferring support pillars onto a substrate using the automatic support pillar transfer mechanism with the above-mentioned structure will be described below with reference to FIG. 2. It is now assumed that the substrate 16 onto which the support pillars 15 are transferred acts as an anode substrate.

The jig 7 is placed on the jig adjusting section 6 and is positioned and held on the base 1. In response to an operational starting instruction from the setting means 20, the control means 21 controls the drive means 34 to descend the moving section 12 along the main frame 11. The control means 21 recognizes the parallelism of the jig 7 based on the measurement values from the length measuring device 18 obtained when the jig surface detecting means 17 makes contact with the surface of the positioning plate 54 of the jig 7.

In concrete, first, when the center jig surface touch sensor 17A acting as a reference point makes contact with the surface of the positioning plate 54 of the jig 7 and then is turned ON, the measurement value hX1 is read from the length measuring device 8. Next, when both the center jig surface touch sensor 17A and the left jig surface touch sensor 17B make touch with the surface of the positioning plate 54 of the jig 7 and is turned ON, the difference ΔY1 between the measurement values from the respective length measuring devices 18 is read. Moreover, when both the center jig surface touch sensor 17A and the right jig surface touch sensor 17C make touch with the surface of the positioning plate 54 of the jig 7 and is turned ON, the difference ΔZ1 between the measurement values from the respective length measuring devices 18 is read.

Next, in order to zero the differences ΔY1 and ΔZ1 from the length measuring means, the control means 21 controls the drive means 23 to vertically move the elevating sections 6*b* of the jig adjusting section 6. Thus, the jig 7 is adjusted to set the surface of the positioning plate 54 in parallel to the smooth surface of the moving section 12.

When the jig 7 is adjusted in a parallel state, the control means 21 controls the drive means 22 to move the movable table 2 in the left direction shown in FIG. 1(*b*), thus saving the jig 7 from the lowered position of the moving section 12. A desired number of support pillars 15 are inserted and sucked into the through holes 54*a* in the positioning plate 54 of the jig 7. During the above-mentioned operation, the control means 21 controls the drive means 24 to ascend the moving section 12 to the reference position P, so that the bonding agent coated substrate 14 coated with a bonding agent 13 is attached to the moving section 12. Next, the control means 21 controls the drive means 22 to move the movable table 2, so that the jig 7 is restored to the lowered position of the moving section 12. In such a state, the control means 21 controls the drive means 24 to lower the moving section 12 by the standard value Hp corresponding to the bonding material transfer height set by the setting means 20. Thus, the bonding agent 13 coated on the bonding agent coated substrate 14 is transferred onto the top ends of the support pillars 15.

Next, the control means 21 controls 22 to move the movable table in the right arrow direction to the extent that the block 4 reaches the lowered position of the moving section 12. During the above-mentioned operation, the control means 21 controls the drive means 24 to ascend the moving section 12 to the reference position P. Then, the bonding agent coated substrate 14 is removed and is attached to the anode substrate 16 forming an envelope for a field emission display.

In such a state, the control means 21 controls the drive means 24 to descend the moving section 12 on which the anode substrate 16 is attached, along the main frame 11. The control means 21 recognizes variations in thickness of the anode substrate 16 based on the measurement values from the length measuring device 18 obtained when the substrate surface detecting means 5 makes contact with the surface of the anode substrate 16.

In concrete, the measurement value hX2 from the length measuring device 18 is read out when the center substrate surface touch sensor 5A is in contact with the surface of the anode substrate 16 and is turned ON. Next, when both the center substrate surface touch sensor 5A and the left substrate surface touch sensor 5B are in contact with the surface of the anode substrate 16 and are turned ON, the difference ΔY2 between measurement values from the respective length measuring devices 18 are read out. Moreover, when both the center substrate surface touch sensor 5A and the right substrate surface touch sensor 5C are in contact with the surface of the anode substrate 16 and are turned ON, the difference ΔZ2 between measurement values from the respective length measuring devices 18 are read out.

Next, the control means 21 controls the drive means 23 based on the differences ΔY2 and ΔZ2 between the measurement values from measuring devices 18 to set the surface of the anode substrate 16 in parallel to the surface of the positioning plate 54, so that the elevating sections 6*b* and 6*b* of the jig adjusting section 6 are moved upward and downward.

When the surface of the positioning plate 54 in the jig 7 is adjusted in parallel to the surface of the anode substrate 16, the control means 21 controls the drive means 24 to descend the moving section 12 attached to the anode substrate 16 by the standard value Hs of a support pillar transfer height set by the setting means 20. All the support pillars 15 coated with the bonding agent 13 are transferred onto the anode substrate 16.

The present embodiment has the following advantages.

Since the control means 21 can automatically transfer the support pillars 15 to be arranged within an envelope for a field emission device under numerical control, a mass-production device can be realized. A support pillar transfer range of the support pillars 15 can be enlarged, compared with the conventional transfer range. In concrete, the diagonal screen size can be enlarged to about 25 cm at least four times the conventional screen size of about 12 cm.

Using the touch sensors 6A to 5C and 7A to 7C allows necessary functions to be realized at the manufacturing costs of about 1/10, compared with the existing laser length measuring device. Moreover, that feature can eliminate an access to the process area by a worker and can reduce the probability that the dust scattered onto the work piece from a worker causes a production failure.

Since the membrane filter with a broader resilient deformation range is used for the cushioning material 10, it can be certainly performed to enlarge the transfer allowable range of the support pillars 15 and to transfer the support pillars 15 over a large area.

In the above-mentioned embodiment, the support pillars 15 to be arranged within an envelope for a field emission display have been typically used as work pieces. However, bead-soldering balls of a diameter Φ of 50 μm may be used as the work pieces. The bead soldering balls can be utilized for the bump formation for a flip-chip-type IC assembly by transferring soldering balls onto wiring patterns formed on a printed board in a process similar to that in the above-mentioned embodiment.

As clearly understood from the above description, the present invention can automate the step of transferring support pillars for a field emission display, can realize mass-produced devices, and can enlarge the support pillar transferable range.

Furthermore, the invention can eliminate an access to the process area by an operator and can reduce the probability that the dust scattered onto the work piece from an operator causes a production failure.

Since a porous sheet with a wide resilient deformation range is used as the cushioning material, the support pillar transferable range can be enlarged so that support pillar transfer can be certainly performed over a large area.

What is claimed is:

1. An automatic support pillar transfer mechanism comprising:

a jig for sucking and holding plural support pillars at predetermined intervals;

measuring means for measuring a variation in plane orientation of a surface of said jig and a variation in plane orientation of a surface of a substrate onto which said support pillar is transferred;

jig adjusting section for positioning and holding said jig and for adjusting the parallelism of the plane orientation of said jig surface based on measurement results from said measuring means;

a moving section for vertically moving a substrate on which a bonding agent is applied or a substrate onto which said support pillars are transferred, wherein said substrate can be attached to or detached from said moving section; and control means for controlling movement of said moving means so as to apply said bonding agent on said support pillars or to transfer said support pillars on which said bonding agent is applied, to said substrate, based on said measurement results from said measuring means.

2. The automatic support pillar transfer mechanism defined in claim 1, wherein said measuring means comprises jig surface detecting means arranged at least three points on the surface of said moving section and not positioned along the same straight line, for detecting the presence or absence of contact to a surface of said jig, any one of said at least three points being set as a reference point, substrate detecting means for arranged at at least three points on the surface facing a surface of said moving section and not positioned along the same straight line, for detecting the presence or absence of contact to a surface of said moving section, any one of said at least three points being set as a reference point, and length measuring means for measuring a movement amount from said reference point when said jig surface detecting means makes contact with a surface of said jig or when said substrate surface detecting means makes contact with a surface of said substrate; and wherein said control means controls the driving operation of said jig adjusting section based on a difference between a measurement value from said measuring means when said jig surface detecting means acting as a reference point makes contact with a surface of said jig and a measurement value from said measuring means when the remaining jig surface detecting means makes contact with a surface of said jig, and then adjusts the surface of said jig in parallel; and wherein said control means controls the driving operation of said jig adjusting section based on a difference between a measurement value from said measuring means when said substrate surface detecting means acting as a reference point makes contact with a surface of said substrate and a measurement value from said measuring means when the remaining substrate surface detecting means makes contact with a surface of said substrate, and then adjusts the surface of said jig to be in parallel to the surface of said substrate.

3. The automatic support pillar transfer mechanism defined in claim 1 or 2, wherein said jig comprises:

a positioning plate having through holes through which said support pillars are inserted, said through holes being formed at predetermined intervals;

a cushioning material formed of a fine porous material having a predetermined resilience;

a porous material closely arranged to the lower portion of said cushioning material, said porous material having plural porosities of a predetermined diameter;

a suction apparatus for sucking said support pillars inserted into said through holes via said cushioning material and said porous material.

4. A support pillar transferring method comprising the steps of: measuring the plane orientation of a surface of a jig which sucks and holds plural support pillars at predetermined intervals;

adjusting the surface of said jig in parallel according to measurement results on the plane orientation of the surface of said jig;

holding said plural support pillars in said jig adjusted in parallel by suction so as to be arranged at predetermined intervals and thus coating a bonging agent on one ends of said plural support pillars;

measuring a variation in plane orientation of a surface of said substrate to which plural support pillars are transferred; and arranging the surface of said jig to the surface of said substrate in parallel according to the measurement results on the variation in plane orientation of the surface of said substrate and then transferring said plural support pillars to the surface of said substrate.

* * * * *